US009556693B2

(12) United States Patent
Hallundbæk

(10) Patent No.: US 9,556,693 B2
(45) Date of Patent: Jan. 31, 2017

(54) DISCONNECTING TOOL

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 189 days.

(21) Appl. No.: 14/236,996

(22) PCT Filed: Aug. 30, 2012

(86) PCT No.: PCT/EP2012/066869

§ 371 (c)(1),
(2), (4) Date: Feb. 4, 2014

(87) PCT Pub. No.: WO2013/030282

PCT Pub. Date: Mar. 7, 2013

(65) Prior Publication Data

US 2014/0158371 A1 Jun. 12, 2014

(30) Foreign Application Priority Data

Aug. 31, 2011 (EP) ..... 11179622

(51) Int. Cl.
*E21B 23/14* (2006.01)
*E21B 43/10* (2006.01)
(Continued)

(52) U.S. Cl.
CPC ..... *E21B 23/00* (2013.01); *E21B 23/06* (2013.01); *E21B 23/14* (2013.01); *E21B 33/127* (2013.01); *E21B 43/10* (2013.01); *E21B 43/103* (2013.01)

(58) Field of Classification Search
CPC ..... E21B 23/00; E21B 23/04
See application file for complete search history.

(56) References Cited

U.S. PATENT DOCUMENTS 6,102,624 A 8/2000 Delaforce
2004/0089445 A1 5/2004 Angman et al.
(Continued)

FOREIGN PATENT DOCUMENTS

CA 2765929 A1 * 12/2010 ..... E21B 17/06
EA 200700517 A1 12/2007
(Continued)

OTHER PUBLICATIONS

International Search Report and Written Opinion for PCT/EP2012/066869, mailed Feb. 5, 2013.
(Continued)

*Primary Examiner* — Giovanna C Wright
*Assistant Examiner* — Manuel C Portocarrero
(74) *Attorney, Agent, or Firm* — Nixon & Vanderhye P.C.

(57) ABSTRACT

The present invention relates to a disconnecting tool (1) for disconnecting a drill pipe from a lower casing in a bore-hole and having an axial extension along a centre line (2), comprising an axial force generator (4) comprising a first part (5) and a second part (6) and providing an axial movement of the second part in relation to the first part along the axial extension, a wireline (3) powering the axial force generator, and an element (7) comprising a leading part (8) and a trailing part (9), the second part being connected with the trailing part, wherein a fluid channel (10) extends from the leading part to the trailing part for letting fluid through or pass the element when the second part is moved in relation to the first part of the force generator during disconnection.

18 Claims, 11 Drawing Sheets

(51) Int. Cl.

| | |
|---|---|
| ***E21B 33/127*** | (2006.01) |
| ***E21B 23/00*** | (2006.01) |
| ***E21B 23/06*** | (2006.01) |

(56) References Cited

U.S. PATENT DOCUMENTS

| | | | | |
|---|---|---|---|---|
| 2005/0139357 | A1 | 6/2005 | Martin et al. | |
| 2009/0025941 | A1 | 1/2009 | Iskander et al. | |
| 2012/0186826 | A1* | 7/2012 | Le Briere ..... | E21B 17/06 166/377 |
| 2015/0315895 | A1 | 11/2015 | Patel et al. | |

FOREIGN PATENT DOCUMENTS

| | | | |
|---|---|---|---|
| EP | 1 624 152 | A2 | 2/2006 |
| EP | 2 312 119 | A1 | 4/2011 |
| GB | 2 236 550 | | 4/1991 |
| GB | 2 310 677 | A | 9/1997 |
| RU | 2 166 146 | C2 | 4/2001 |
| RU | 2010 106 628 | A | 8/2011 |
| WO | WO 2008/128543 | | 10/2008 |
| WO | WO 2010/146305 | A1 | 12/2010 |

OTHER PUBLICATIONS

Notification Concerning Transmittal of International Preliminary Report on Patentability and Written Opinion for PCT/EP2012/066869, issued Mar. 4, 2014, 8 pages.

Office Action dated Jul. 26, 2016 issued in U.S. Appl. No. 15/161,444 (18 pages) citing US 2004/0065474 A1, published Apr. 2004 to Turner and US 2011/0266004 A1, published Nov. 2011 to Hallundbæk.

Decision on Patent Grant for Invention mailed Aug. 29, 2016 in Russian Application No. 2014109694/03(015307), with English Translation (16 pages).

Extended European Search Report mailed Nov. 18, 2016 in European Application No. 16171537.0 (8 pages).

* cited by examiner

DISCONNECTING TOOL

This application is the U.S. national phase of International Application No. PCT/EP2012/066869, filed 30 Aug. 2012, which designated the U.S. and claims priority to EP Application No. 11179622.3, filed 31 Aug. 2011, the entire contents of each of which are hereby incorporated by reference.

FIELD OF THE INVENTION

The present invention relates to a disconnecting tool for disconnecting a drill pipe from a lower casing. The invention further relates to a method and a downhole system.

BACKGROUND ART

In wellbores, annular barriers are used for providing zone isolation and isolation of the production zone through which the recovery of hydrocarbon takes places. The annular barriers form part of the lower casing and are submerged into the borehole by means of a drill pipe. In order to expand the expandable sleeves of the annular barriers, the drill pipe is pressurised from the top of the well, often from the rig, and all the sleeves of the annular barriers can thus be expanded or set in one operation step. Subsequently, the drill pipe is released from the lower casing, leaving the lower casing fastened in the borehole.

By conventional running tools, the disconnection mechanism is activated by rotating the drill pipe or dropping a ball into a ball seat in the running tool and then pressurising the drill pipe once more to move the seat and release the running tool from the lower casing. However, neither of these solutions is useful for providing zone isolation when using annular barriers as the expanded annular barriers must not be rotated, which will occur when rotating the drill pipe. Nor must the lower casing be pressurised to a level above that at which the annular barriers are expanded, which will occur with the solution of dropping the ball and subsequently pressurising once more.

SUMMARY OF THE INVENTION

It is an object of the present invention to wholly or partly overcome the above disadvantages and drawbacks of the prior art. More specifically, it is an object to provide an improved solution for disconnecting a running tool and drill pipe from the lower casing without damaging the zone isolation provided by expanded annular barriers.

The above objects, together with numerous other objects, advantages, and features, which will become evident from the below description, are accomplished by a solution in accordance with the present invention by a disconnecting tool for disconnecting a drill pipe from a lower casing in a borehole and having an axial extension along a centre line, comprising:

- an axial force generator comprising a first part and a second part and providing an axial movement of the second part in relation to the first part along the axial extension,
- a wireline powering the axial force generator, and
- an element comprising a leading part and a trailing part, the second part being connected with the trailing part, wherein a fluid channel extends from the leading part to the trailing part for letting fluid through or pass the element when the second part is moved in relation to the first part of the force generator during disconnection.

In one embodiment, the disconnecting tool may comprise an outer face, and the fluid channel may have an inlet in the leading edge and an outlet ending in the outer face of the tool.

In another embodiment, the fluid channel may extend from an inlet in the leading part to an outlet in the trailing part for letting fluid through or pass the element.

In another embodiment, the fluid channel may extend on an outside surface of the element from the leading part to the trailing part for letting fluid pass the element.

Also, the fluid channel may be a groove or a cavity arranged in the outside surface of the element.

Moreover, the leading part may have a front face and the inlet in the leading part may be arranged in the front face.

Further, the inlet in the leading part may be arranged at the centre line.

Additionally, the inlet in the leading part may be arranged offset in relation to the centre line.

In an embodiment, the leading part may be arranged overlapping the centre line.

The outlet in the trailing part may be arranged at a larger distance to the centre line than the inlet in the leading part.

Also, the outlet in the trailing part may be arranged at the centre line, and the fluid channel may extend into the second part to a second outlet arranged in the second part.

Furthermore, the front face may overlap the centre line.

In addition, the leading part of the element and/or the front face may taper along the centre line.

Moreover, the leading part of the element and/or the front face may taper along the centre line to have a larger width nearest the trailing part.

In an embodiment, a plurality of fluid channels may extend from one or more inlets(s) in the leading part to a plurality of outlets in the trailing part.

Said plurality of fluid channels may extend from an inlet in the leading part to outlets in the trailing part.

The trailing part may have a back face, and the second part may be connected with the back face.

Further, the outlet in the trailing part may be arranged in the back face.

An area of the back face may be equal to or larger than an area of the front face.

The leading part of the element may be hemispherical.

Also, the element may be hemispherically shaped, spherically shaped, ball-shaped, elliptically shaped, cone-shaped, truncated cone-shaped, half-moon-shaped, star-shaped, triangular-shaped, square-shaped, or a combination thereof.

The element may overall taper from the trailing part towards the leading part. Moreover, the front face of the leading part may provide a tip (or point) to the element.

Said element may be made of metal.

Additionally, the tool may comprise a pump and/or an electrical motor powered by/from the wireline.

Furthermore, the tool may comprise an anchor unit and/or a driving unit, such as a downhole tractor.

In addition, the axial movement of the second part may be provided by an electrical motor, a hydraulic piston arrangement, a spindle, a toothed shaft in engagement with a gear wheel, or a combination thereof.

The present invention further relates to a downhole system comprising:

- a running tool,
- a drill pipe, and
- a disconnecting tool according to any of the preceding claims.

This system may comprise a lower casing which is provided with one or more annular barrier(s) having an expandable sleeve expandable within the borehole for providing zone isolation.

The present invention also relates to a method for expanding an expandable sleeve of an annular barrier in a borehole having an upper casing, comprising:

connecting a lower casing having one or more annular barrier(s) with a running tool, connecting the running tool with a drill pipe, lowering the drill pipe, running tool and lower casing into the borehole, expanding the expandable sleeve of the one or more annular barrier(s) and connecting the lower casing with the upper casing, disconnecting the running tool from the lower casing by means of the disconnecting tool as described above, and raising the running tool, the drill pipe and the disconnecting tool.

Finally, the present invention relates to a well system comprising an upper casing, a lower casing having annular barriers, a running tool and the disconnecting tool as described above.

BRIEF DESCRIPTION OF THE DRAWINGS

The invention and its many advantages will be described in more detail below with reference to the accompanying schematic drawings, which for the purpose of illustration show some non-limiting embodiments, and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
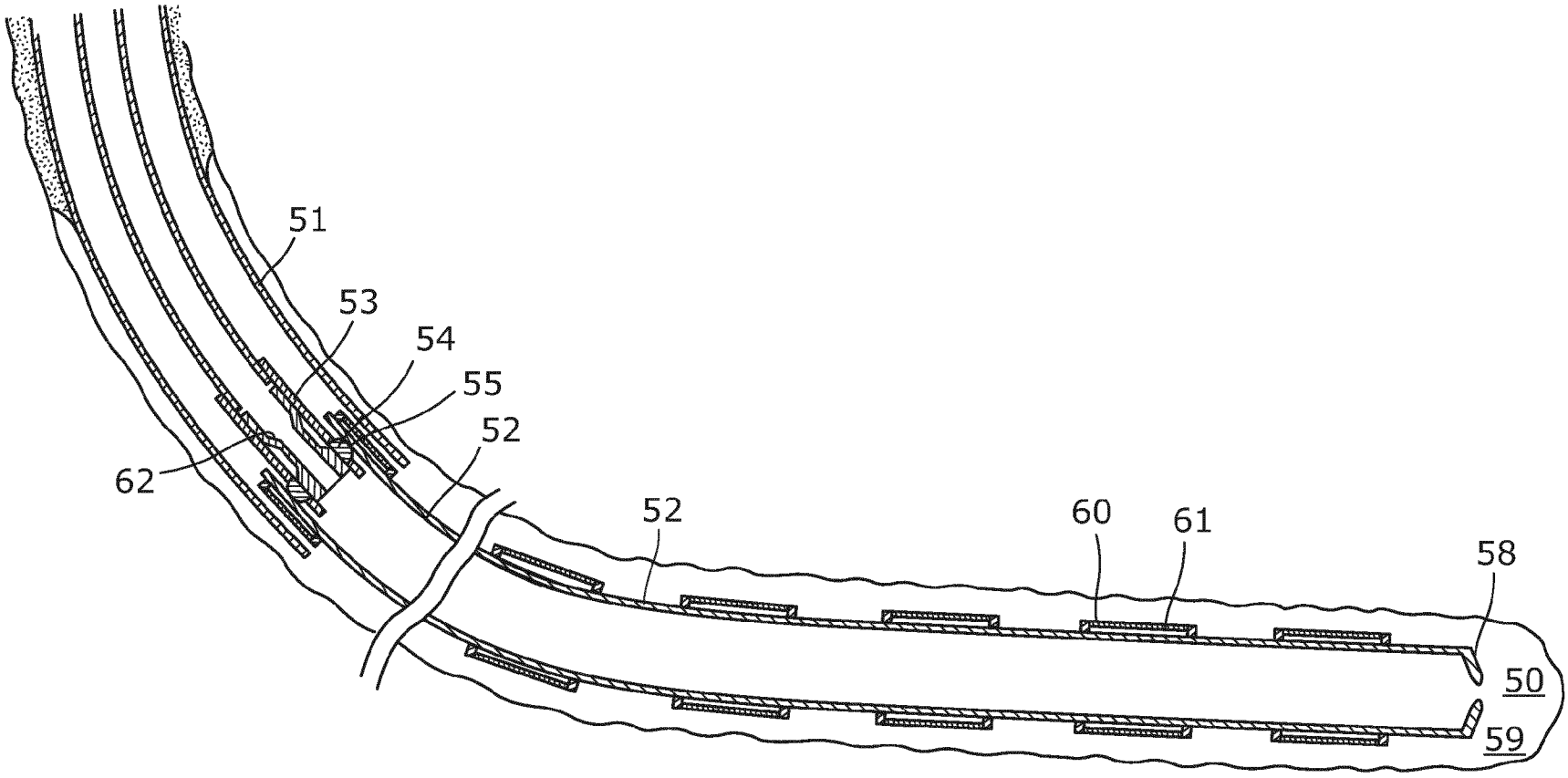
FIG. 1 shows a cross-sectional view of a downhole system.
Figure 2:
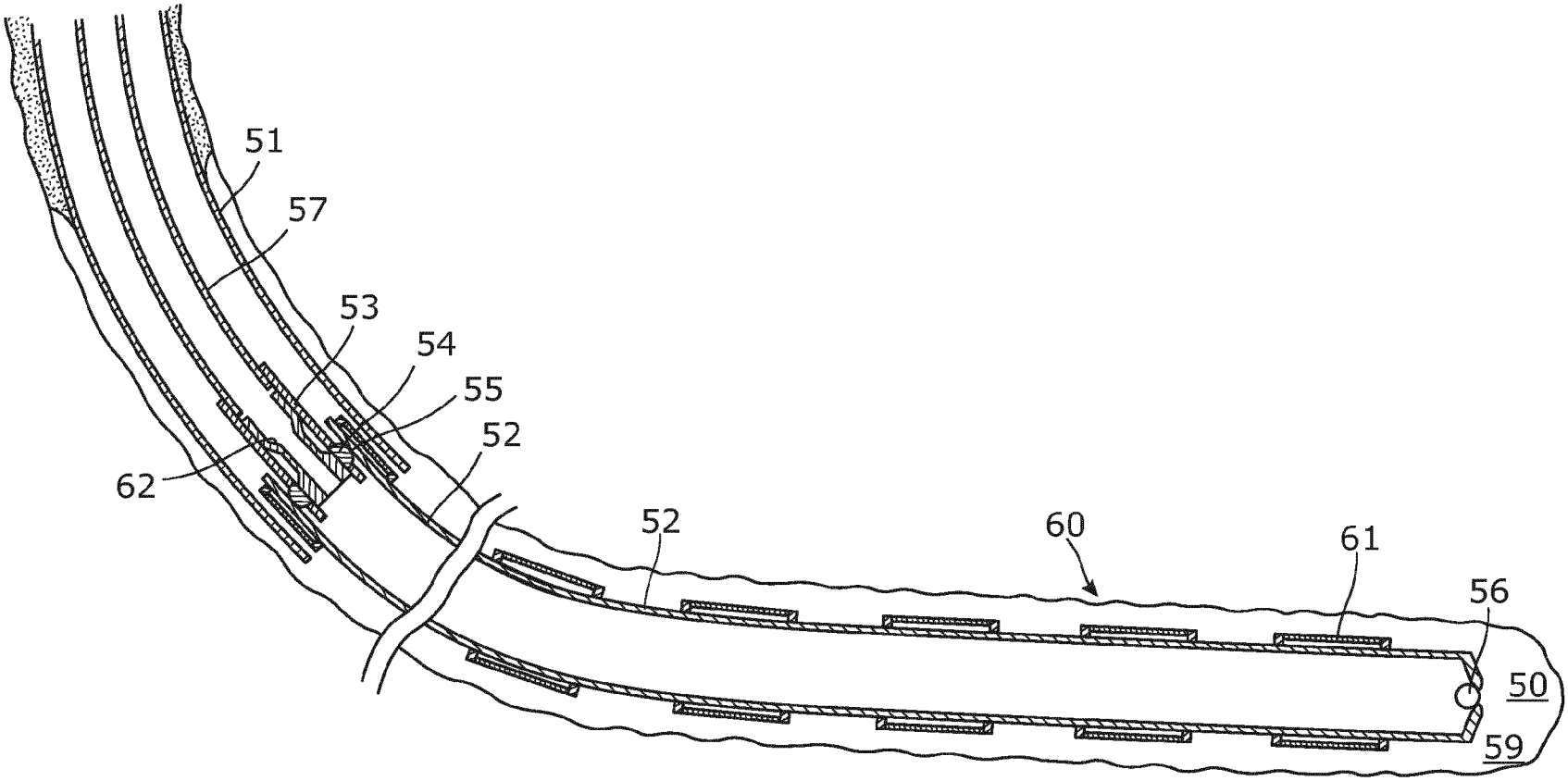
FIG. 2 shows a cross-sectional view of a downhole system being closed by a drop ball.
Figure 3:
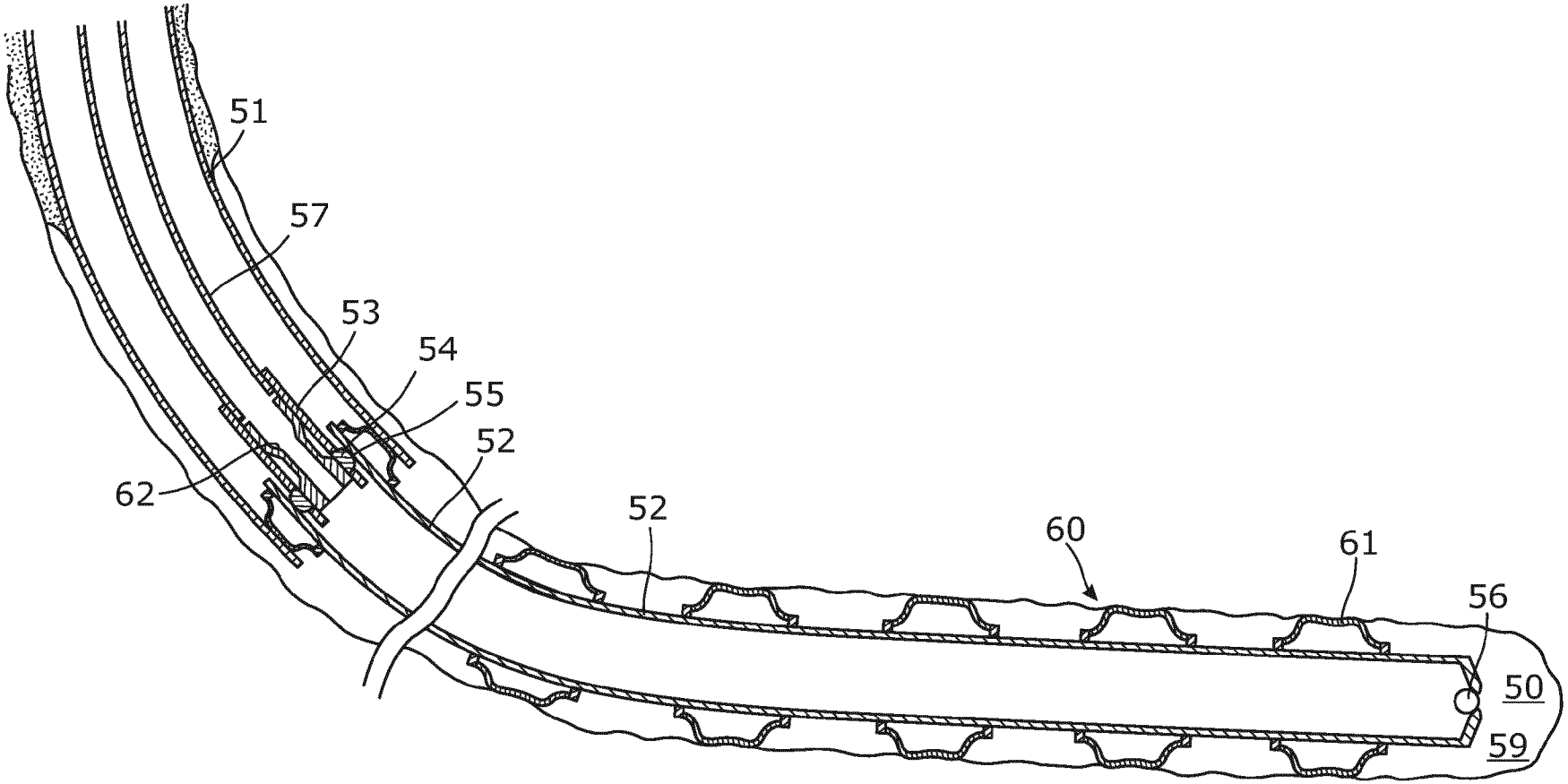
FIG. 3 shows a cross-sectional view of a downhole system having expanded annular barriers.

The present invention relates to a disconnecting tool 1 for disconnecting the equipment used for completing a well. The well has a borehole 50 in which an upper casing 51 is arranged at the top of the well, extending all the way to the well head at the top part of the well. Subsequently, a lower casing 52 having annular barriers 60 with expandable sleeves 61 is installed in the lower part of the well to be an extension of the upper casing 51. The lower casing is connected to a running tool, such as a tubing hanger running tool 53, in its one end by means of dogs 54 engaging a cavity 55 in the lower casing. The tubing hanger running tool 53 is, at its other end, threadingly connected with a drill pipe 57. Then, the lower casing is submerged into the borehole by means of the tubing hanger running tool 53 and the drill pipe 57, as shown in FIG. 1. When the lower casing is in its intended position in the borehole, a ball 56 is dropped into the fluid inside the drill pipe 57, and the drill pipe is pressurised so that the ball 56 flows down to the bottom of the well and is seated in a ball seat 58 closing the lower casing 52 from the surrounding annulus 59, as shown in FIG. 2. The drill pipe is further pressurised to pressurise also the lower casing in order to expand the expandable sleeves of the annular barriers. This is done to fasten the lower casing in the bore and provide zone isolation of the annulus, as shown in FIG. 3. In FIG. 3, the lower casing is fastened with the upper casing by means of an annular barrier.

Figure 4:
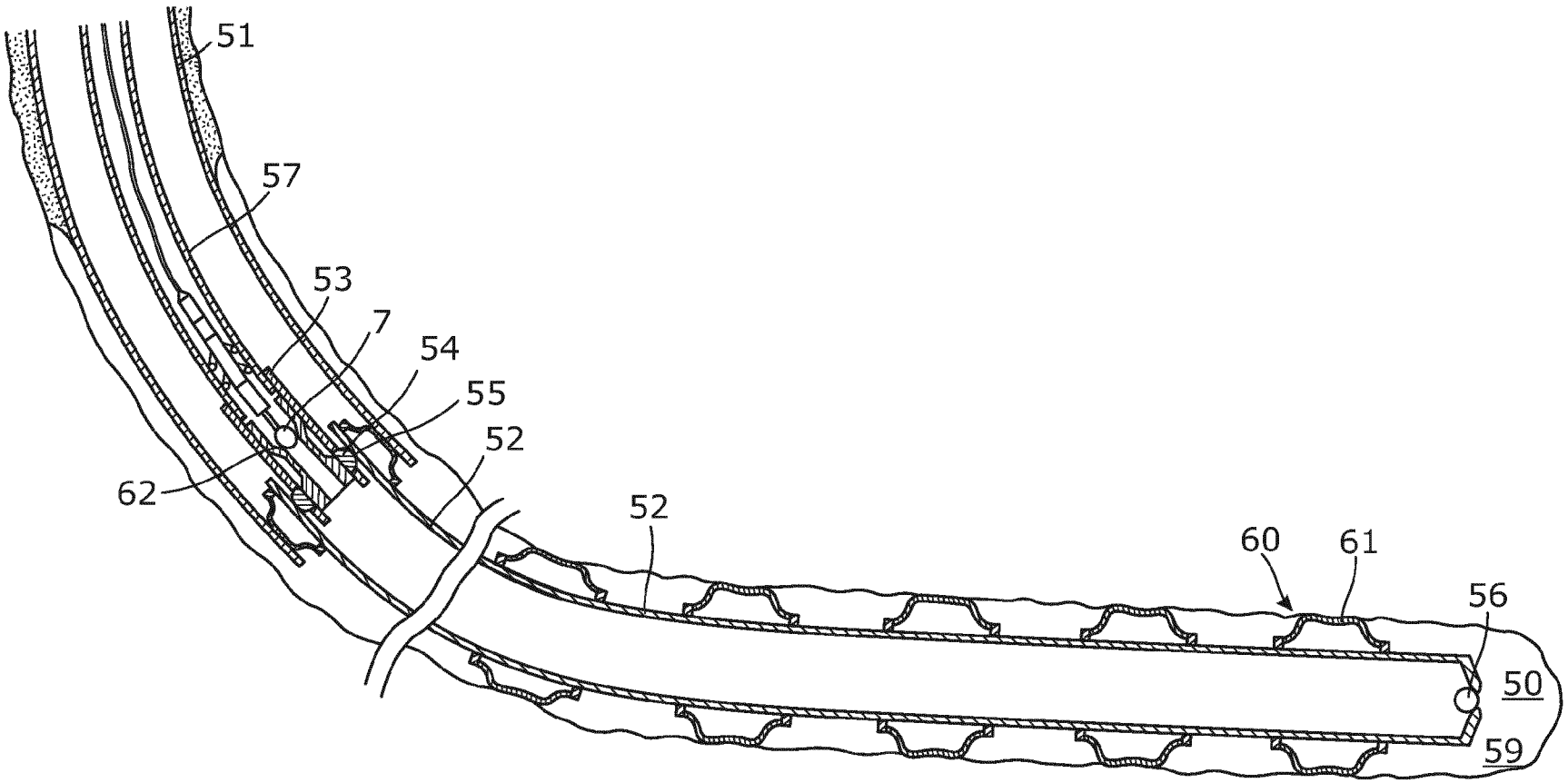
FIG. 4 shows the system of FIG. 3 in which a disconnecting tool is arranged.
Figure 5:
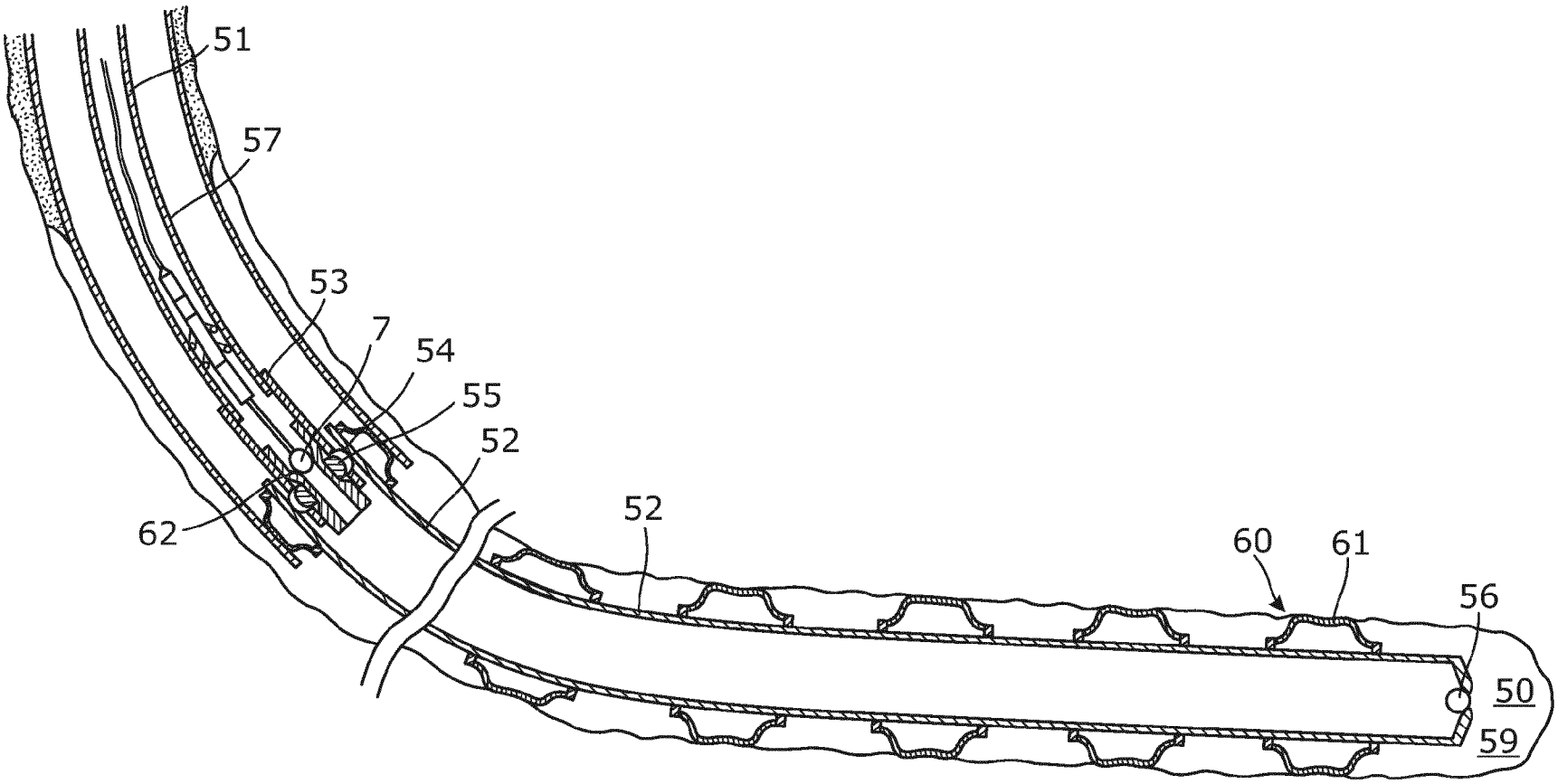
FIG. 5 shows the system of FIG. 4 in which the disconnecting tool has disconnected the running tool from the lower casing.

In FIG. 4, the expansion process has been completed, and the disconnecting tool is run into the drill pipe 57 in order to disconnect the running tool 53 from the lower casing 52. This is done by seating an element into a ball seat 62 or the like in the running tool and subsequently providing an axial force of the element, moving the seat and unlocking the running tool, as shown in FIG. 5. Hereby, the dogs in the running tool 53 are retracted from the cavity in the lower casing 52, thus separating the running tool 53 from the lower casing and the drill pipe 57.

Figure 6:
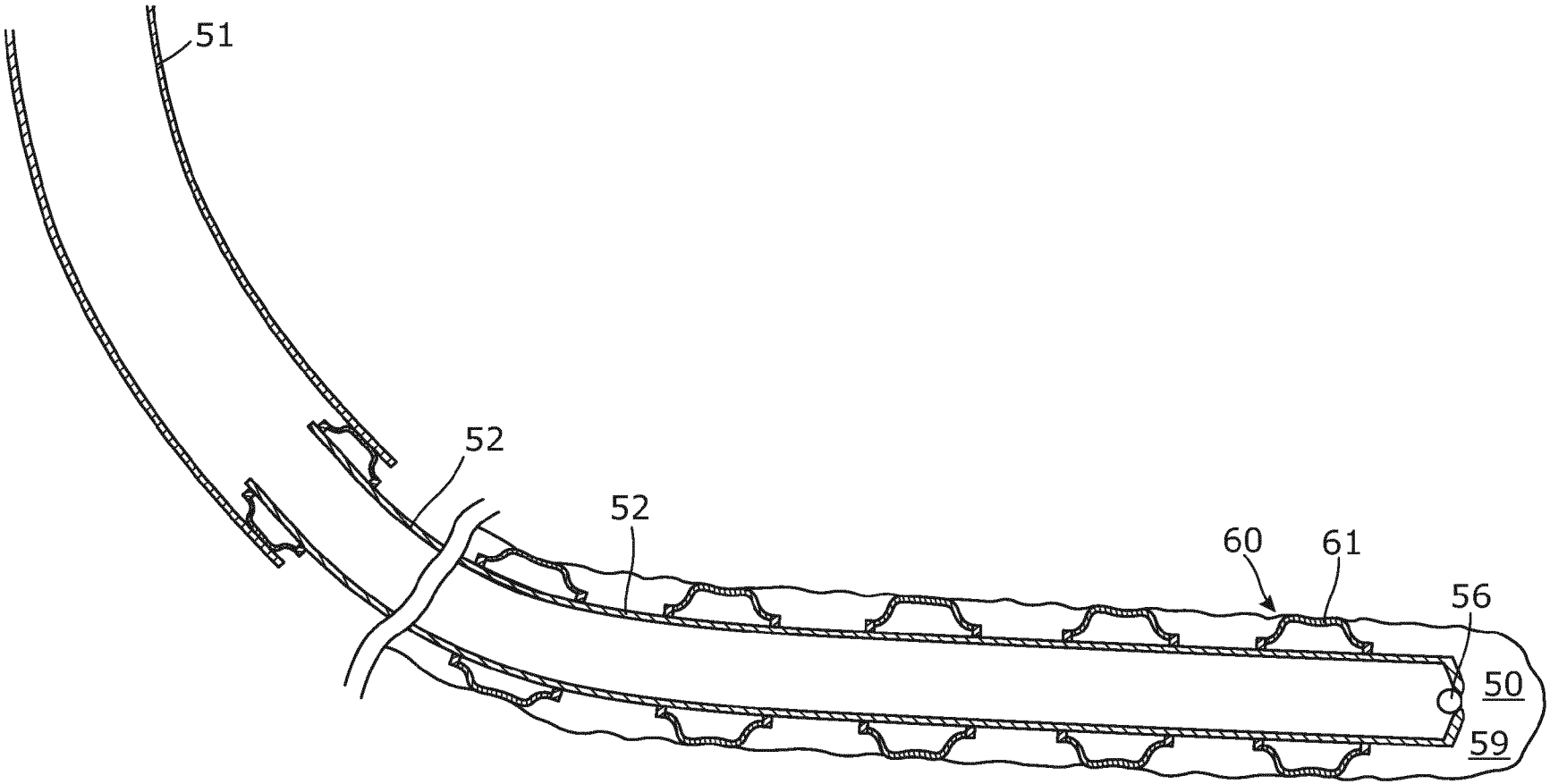
FIG. 6 shows the system of FIG. 4 in which the running tool and drill pipe have been withdrawn.

The running tool and the disconnecting tool 1 are then raised from the well, leaving the installed lower casing in the borehole, as shown in FIG. 6.

Figure 7:
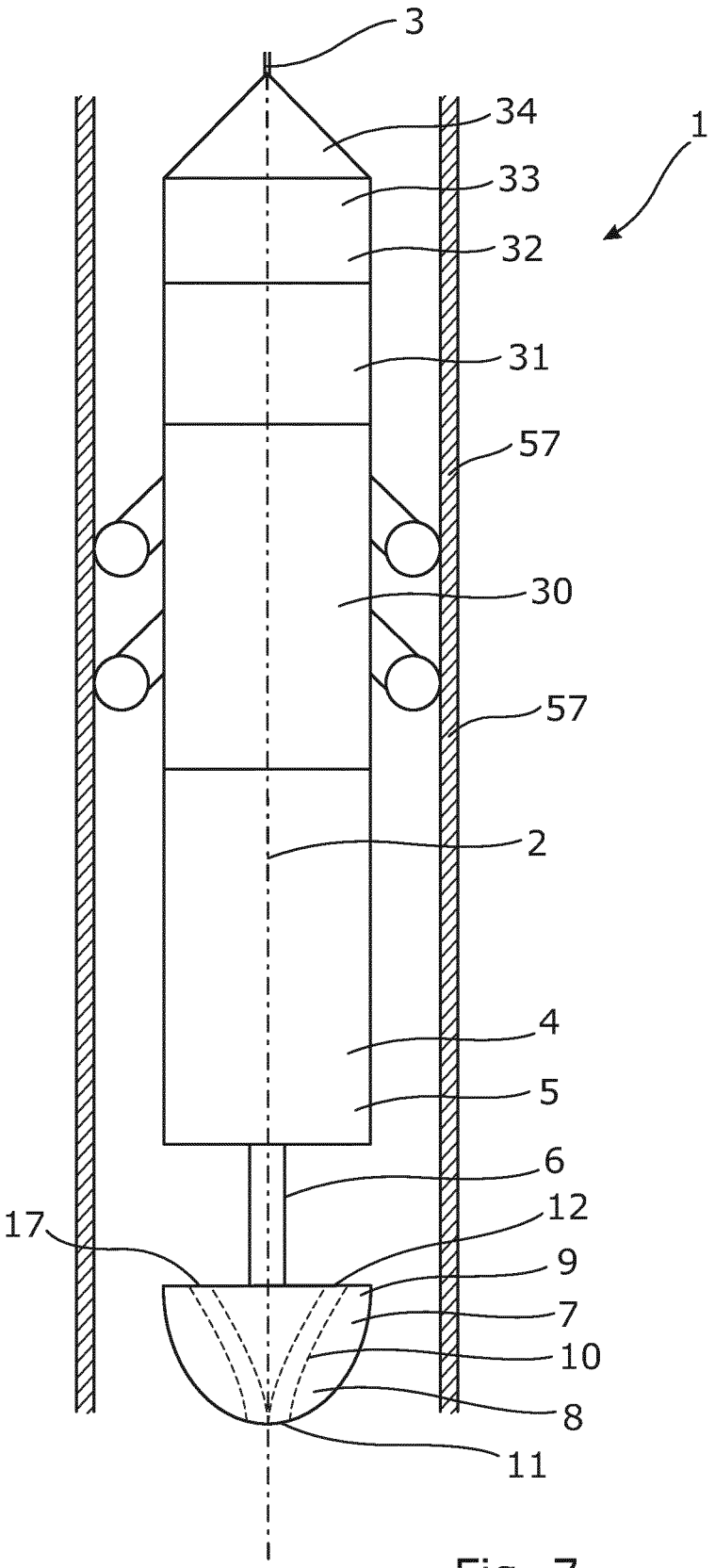
FIG. 7 shows the disconnecting tool in connection with a downhole tractor.

In FIG. 7, a disconnecting tool 1 has an axial extension along its centre line 2, an outer face 20 and a wireline 3 which is connected with an axial force generator 4. The axial force generator 4 comprises a first part 5 and a second part 6. The axial force generator 4 provides an axial movement of the second part in relation to the first part along the axial extension to move an element 7. The element 7 comprises a leading part 8 and a trailing part 9, and the second part of the axial force generator 4 is connected with the trailing part of the element. The element of the disconnecting tool 1 has a fluid channel 10 extending from an inlet 11 in the leading part to an outlet 12 in the outer face of the tool. In this way, fluid in the lower casing can enter through or along the fluid channels when the element seated in the seat of the running tool is forced away from the upper casing 51 to move the seat of the running tool 53 and release the running tool.

When expanding the expandable sleeve 61 of the annular barriers 60, the inside of the lower casing 52 is pressurised to a pressure difference level of e.g. 5,000 PSI, which level is set from the design of the other components in the lower casing, such as the inflow control valve, fracturing ports, sliding sleeves etc. Thus, the completion can withstand more than this maximum level of pressure, such as 5,000 PSI, and it is crucial that this level is not exceeded because then the other components of the completion may fail in the recovery of hydrocarbons. Usually, the running tool 53 is disconnected from the lower casing 52 by dropping a ball into the seat of the running tool or by twisting the drill pipe 57. When dropping a ball into the seat of the running tool, the drill pipe is pressurised again to move the seat. However, when moving the seat, the pressure in the lower casing is increased above the maximum level, which is not acceptable and therefore not allowable.

When twisting or rotating the drill pipe 57 and thus part of the running tool 53, there is a risk of rotating the lower casing initially before releasing the running tool from the lower casing 52. A slight rotation of the lower casing may result in the annular barriers being rotated as well, which may cause a leak in the expandable sleeve and thus result in the zone isolation being destroyed.

By the disconnecting tool 1 comprising an element 7 having fluid channels having outlets offset or facing the inner face 22 of the drill pipe, the fluid in the lower casing 52 can flow in through the channels and out into the drill pipe 57. Thus, the pressure in the lower casing is not increased, thereby reducing the risk of other components in the completion being destroyed.

When the disconnecting tool abuts the running tool connected to the lower casing, the disconnecting tool divides the well into an upper and a lower well part, and fluid from the lower well part is only allowed to flow through the fluid channel in the element due to the fact that the element abuts a seat in the running tool. Disconnecting the drill pipe from the lower casing will result in the fluid in the lower part flowing to the upper part. In prior art tools, the fluid in the lower casing is "pressed together", increasing the pressure in the lower well part, and this increased pressure has to be overcome to force the second part of the tool away from the first part. In the present invention, the fluid is able to flow from a confined area in front of the element to the drill pipe and thereby equalise the pressure across the element while moving the second part in relation to the first part.

Figure 8:
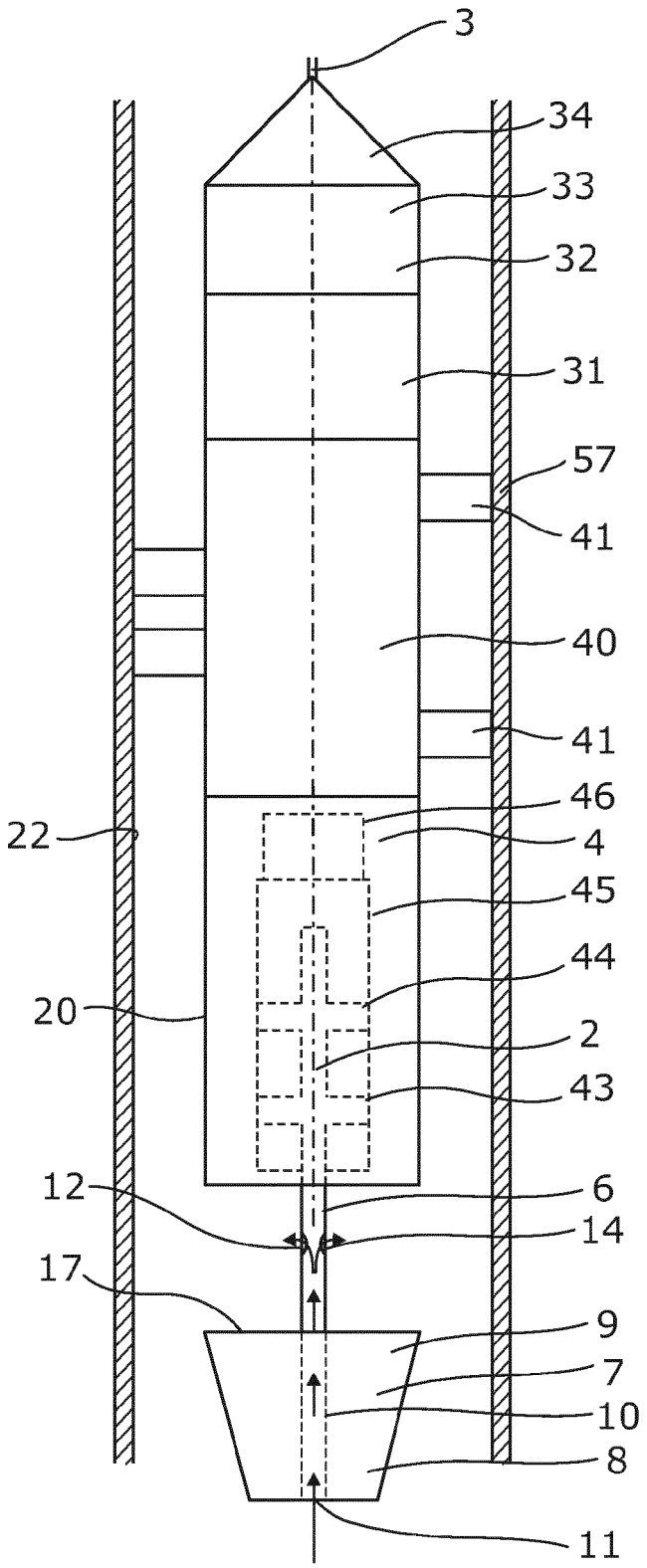
FIG. 8 shows the disconnecting tool in connection with an anchor unit.

When the outlet 12 of the fluid channel is facing the drill pipe, as shown in FIG. 8, the fluid in the lower well part can flow almost freely through the fluid channel, out through the outlet of the fluid channel and into the surroundings of the tool between the tool and the drill pipe. The fluid can thus flow without having to slowly leak out of the tool, which is what will happen with prior art tools e.g. not having an outlet of the fluid channel arranged offset in relation to the inner face of the drill pipe.

In FIG. 7, the fluid channel ends in the element, and in FIG. 8, the fluid channel ends in the vicinity of the element. Thus, the outlet is arranged in the second and moving part and thereby in a non-overlapping manner while the first part is moved in relation to the second part to disconnect the drill pipe from the lower casing.

The axial force generator 4 is connected with a pump 31 driven by an electrical motor 32 and an electrical control unit 33 which is connected through a cable head to the wireline 3 through which it receives power from surface. The axial force generator 4 is moved down through the drill pipe 57 by means of a driving unit, such as a downhole tractor having wheels on arms, caterpillar tracks or any other suitable driving means. The driving means of the driving unit is forced outwards towards the inner surface of the drill pipe while the axial force generator 4 moves the second part 6 and thus the element in relation to the first part 5.

The leading part 8 of the element has a front face 13 being in front of the disconnecting tool 1 when moving forward in the drill pipe 57 towards the lower casing 52 in order to disconnect the running tool 53 from the lower casing. When seated in the ball seat or another type of seat in the running tool 53, most of the front face is exposed in relation to the other part of the leading part 8 which abuts the seat. The inlet 11 is arranged in the front face so that it does not overlap part of the seat, thus diminishing the inlet and reducing the flow of fluid from the lower casing 52 to the drill pipe 57. In FIG. 7, the inlet in the front face of the leading part 8 is arranged at the centre line 2 in the front face of the element, and the inlet thus overlaps the centre line.

The trailing part 9 of the element is connected with the second part 6 of the axial force generator 4. In FIG. 7, the second part 6 is a shaft threadingly connected with a back face 17 of the trailing part 9 of the element 7, and the outlet 12 is arranged in another part of the trailing part 9. In FIG. 8, the shaft is hollow and is also connected with the trailing part of the element, and the outlet is arranged so that the fluid flows into the hollow shaft and out of second outlets in the shaft into the drill pipe 57.

In FIG. 8, the axial force generator 4 is connected with an anchor unit 40, and before the axial force generator 4 provides the axial force on the element and moves the second part 6 in relation to the first part 5, the anchors 41 of the anchor unit 40 is forced outwards towards the inner surface of the drill pipe to provide retention while the axial force generator 4 provides the axial force.

The axial force generator 4 may be hydraulically driven by the pump in that the axial force generator 4 comprises a hydraulic piston arrangement 43 comprising several pistons 44 arranged on a shaft, each in a piston housing 45. The pump 46 pumps fluid into every piston housing, moving the pistons and thus the shaft. The shaft may be the same as the shaft of the second part or it may be connected thereto. In another embodiment, the axial force generator 4 may be directly motor driven without any pump by means of a toothed shaft in engagement with a gear wheel rotated by the motor. The toothed shaft may be the same as the shaft of the second part or it may be connected thereto.

The motor may be powered through the wireline or by a battery.

Figure 9:
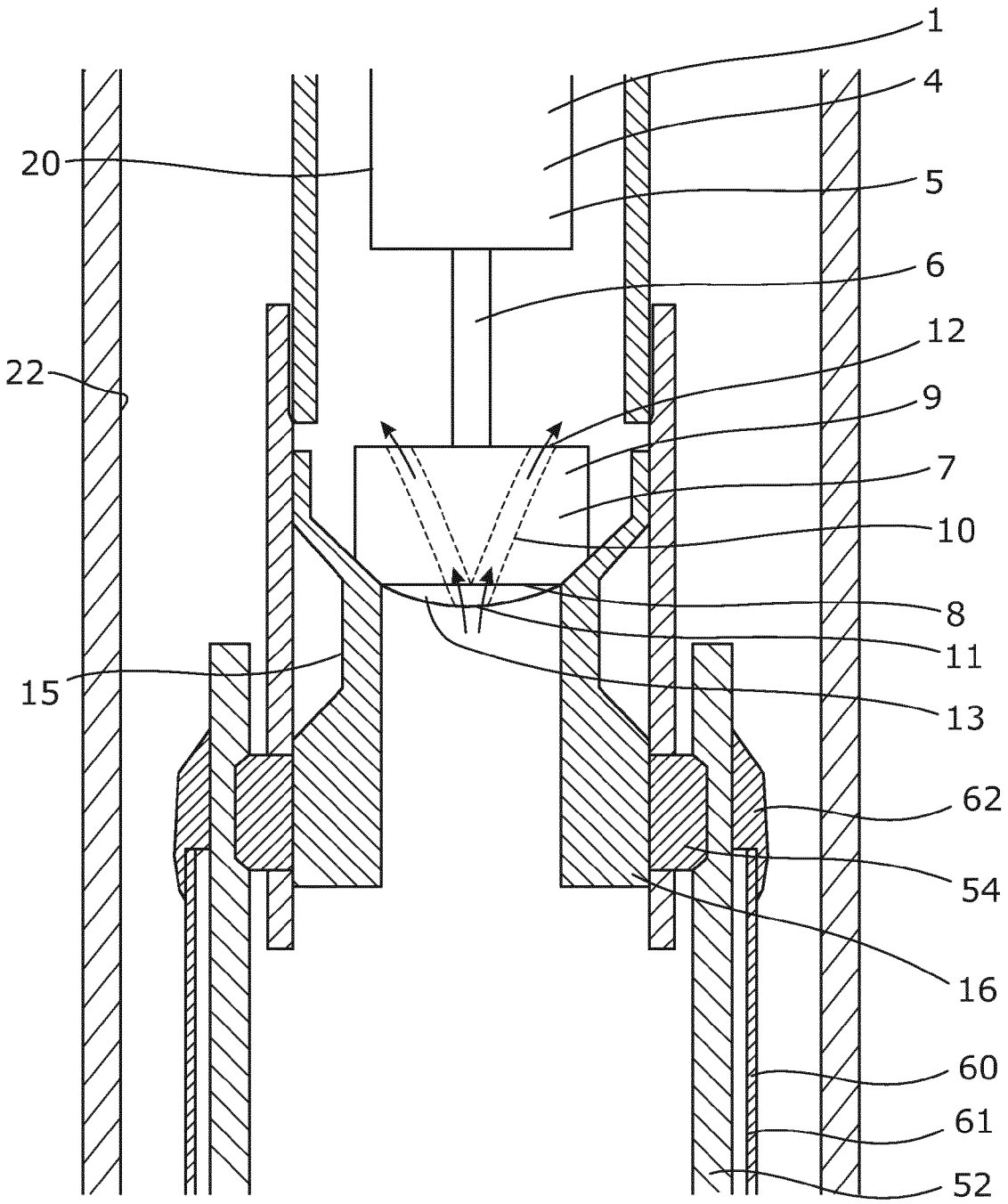
FIG. 9 shows an enlarged view of the running tool in engagement with the lower casing and the drill pipe.

FIG. 9 shows an enlarged view of the running tool 53 in engagement with the drill pipe 57 and the lower casing 52. The seat 62 of the running tool is part of a seat element having a circumferential groove 15 and a projection 16. At the rig or vessel, the running tool is connected with the lower casing by forcing the seat element downwards so that the projection presses the dogs outwards into the cavity 55 in the lower casing 52 thus engaging the lower casing. After the expandable sleeves have been expanded, the disconnecting tool 1 is submerged into the drill pipe 57 or, if already present in the drill pipe, lowered further into the drill pipe. The arms of the downhole tractor or the anchors 41 of the anchor unit 40 anchor the disconnecting tool 1 up inside the drill pipe, and the element is forced further forwards by means of the axial force generator 4 until it seats in the seat of the seat element of the running tool 53. Subsequently, the element is forced further forwards, forcing the seat element to move away from the drill pipe and the dogs pass the projection into the circumferential groove, releasing the seat element from the lower casing 52.

Figure 10:
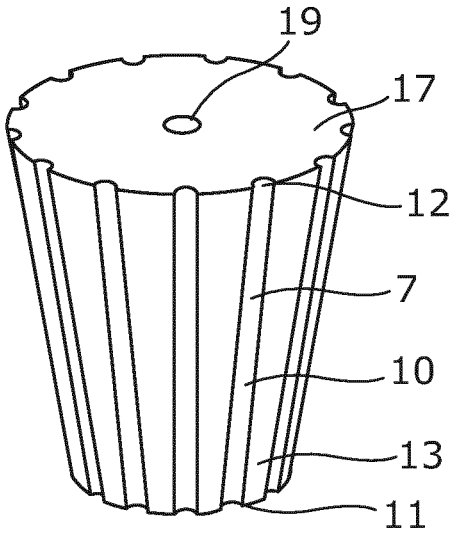
FIG. 10 shows an element having fluid channels in the form of external grooves.

In FIG. 10, the fluid channel extends on an outside surface of the element from the leading part 8 to the trailing part 9 for letting fluid pass the element in the fluid channel being a groove or a cavity arranged on the outside surface of the element. The inlet 11 in the leading part 8 is arranged offset in relation to the centre line 2, and the element has a plurality of inlets, all offset in relation to the centre line 2. The outlets in the trailing part 9 are arranged at a larger distance to the centre line 2 than the inlets in the leading part 8. The connection opening 19 of the element is shown in its top and trailing part.

Figure 11D:
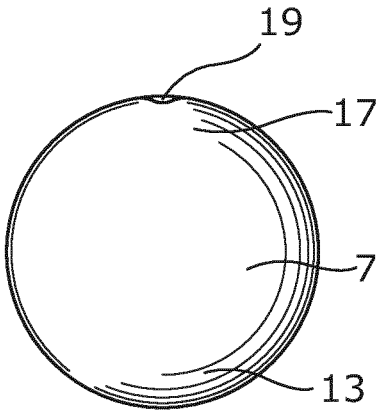
FIGS. 11A-11D show different embodiments of the element seen in perspective from a side.
Figure 11A:
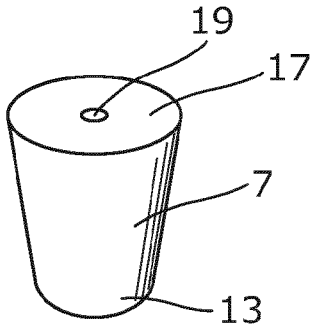
Figure 11B:
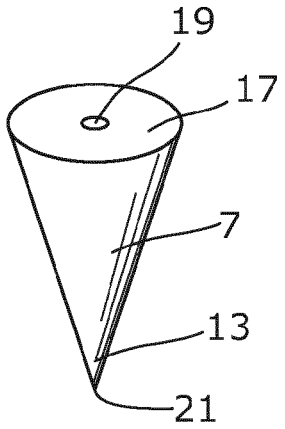
Figure 11C:
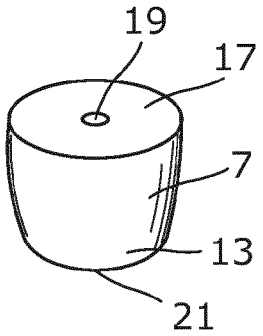

As can be seen in FIGS. 7, 8 and 11A-11C, the element 7 tapers along the centre line 2 from the back face 17 towards the front face 13. In this way, the element 7 tapers along the centre line 2 to have a larger width nearest the trailing part 9. In FIGS. 11A-11B and 11D, the area of the back face is equal to or larger than an area of the front face. In FIG. 11C, the leading part 8 of the element 7 is hemispherical.

Figure 12A:
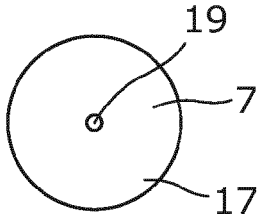
FIGS. 12A-12F show different embodiments of the element seen from the top and trailing face.
Figure 12B:
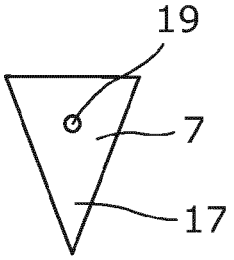
Figure 12C:
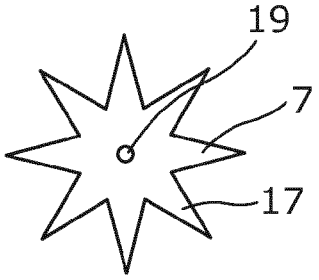
Figure 12D:
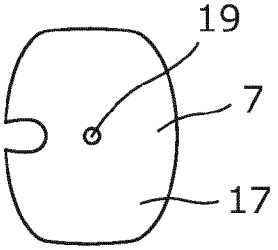
Figure 12E:
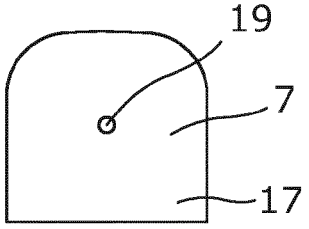
Figure 12F:
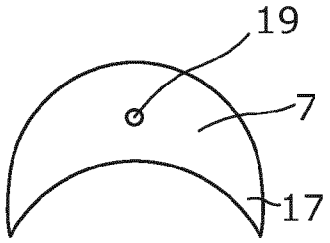

In FIG. 7, the element is hemispherically shaped, and in FIG. 11D, the element is spherically shaped or ball-shaped. In FIG. 11B, the element is cone-shaped, and in FIGS. 8, 10 and 11A, the element is truncated cone-shaped. In FIGS. 12A-12F, the element is seen from the back face of the trailing part, and as can be seen, the element may have a variety of shapes. In FIG. 12F, it is half-moon-shaped, in FIG. 12C, it is star-shaped, in FIG. 12B, it is triangular shaped, in FIGS. 12E-12D, it is almost square shaped, and in FIG. 12A, it has a round shape. The element may also be elliptically shaped when seen from the side.

In FIGS. 11A-11C, the element 7 overall tapers from the trailing part 9 towards the leading part 8. In FIG. 11B, the front face of the leading part 8 provides a tip or point 21 to the element as it tapers into this tip or point 21. The element is made of metal, ceramics, plastic or any other suitable material.

The invention also relates to a downhole system comprising the running tool 53, the drill pipe 57 and the above-mentioned disconnecting tool 1. The system may further comprise a lower casing 52 which is provided with one or more annular barrier(s) 60 having an expandable sleeve 61 expandable within the borehole for providing zone isolation.

An annular barrier may also be called a packer or similar expandable means. The lower and upper casings forming part of the well tubular structure can be the production tubing or casing or a similar kind of tubing downhole in a well or a borehole. The annular barrier can be used both between the inner production tubing and between an outer tubing in the borehole or between a tubing and the inner wall of the borehole. A well may have several kinds of tubing, and the annular barrier of the present invention can be mounted for use in all of them. The expandable sleeve is an expandable tubular metal sleeve and may be a cold-drawn or hot-drawn tubular structure.

The fluid used for expanding the expandable sleeve may be any kind of well fluid present in the borehole surrounding the tool and/or the upper or lower casing. Also, the fluid may be cement, gas, water, polymers, or a two-component compound, such as powder or particles mixing or reacting with a binding or hardening agent. Part of the fluid, such as the hardening agent, may be present in the cavity between the tubular part and the expandable sleeve before injecting a subsequent fluid into the cavity.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tools all the way into position in the well. A downhole tractor is any kind of driving tool capable of pushing or pulling tools in a well downhole, such as a Well Tractor®. A downhole tractor may have wheels on arms projecting from a tool housing of the tractor, or driving belts or caterpillar tracks for moving the tractor forward in the well.

Although the invention has been described in the above in connection with preferred embodiments of the invention, it will be evident for a person skilled in the art that several modifications are conceivable without departing from the invention as defined by the following claims.

The invention claimed is:

1. A disconnecting tool for disconnecting a drill pipe from a lower casing in a borehole and having an axial extension along a centre line, the disconnecting tool comprising:

an axial force generator comprising a first part and a second part and providing an axial movement of the second part in relation to the first part along the axial extension, a wireline powering the axial force generator, and an element comprising a leading part and a trailing part, the trailing part being connected with the second part, wherein a fluid channel extends from the leading part to the trailing part, the fluid channel being configured to permit fluid to flow from a front area in front of the element to a rear area between the trailing part and the first part of the axial force generator when the second part is moved away from the first part of the force generator during disconnection, thus equalizing fluid presssure across the element during disconnection, and wherein the fluid channel has an inlet in the leading part and an outlet leading to the rear area.

2. A disconnecting tool according to claim 1, wherein the fluid channel extends from the inlet in the leading part to the outlet in the trailing part for letting fluid through or past the element.

3. A disconnecting tool according to claim 2, wherein the leading part has a front face and the inlet in the leading part is arranged in the front face.

4. A disconnecting tool according to claim 1, wherein the inlet of the leading part is arranged at the centre line.

5. A disconnecting tool according to claim 3, wherein the front face overlaps the centre line.

6. A disconnecting tool according to claim 1, wherein the leading part of the element and/or the front face tapers along the centre line.

7. A disconnecting tool according to claim 1, wherein a plurality of fluid channels extend from one or more inlets(s) in the leading part to a plurality of outlets in the trailing part.

8. A disconnecting tool according to claim 1, wherein the trailing part has a back face and the second part is connected with the back face.

9. A disconnecting tool according to claim 8, wherein the outlet in the trailing part is arranged in the back face.

10. A disconnecting tool according to claim 1, wherein the leading part of the element is hemispherical.

11. A disconnecting tool according to claim 1, wherein the element is hemi spherically shaped, spherically shaped, ball-shaped, elliptically shaped, cone-shaped, truncated cone-shaped, half-moon-shaped, star-shaped, triangular-shaped, square-shaped, or a combination thereof.

12. A downhole system comprising:

a running tool, a drill pipe, and a disconnecting tool according to claim 1.

13. A downhole system according to claim 12, wherein the system comprises a lower casing which is provided with one or more annular barrier(s) having an expandable sleeve expandable within the borehole for providing zone isolation.

14. A method for expanding an expandable sleeve of an annular barrier in a borehole having an upper casing, comprising:

connecting a lower casing having one or more annular barrier(s) with a running tool, connecting the running tool with a drill pipe, lowering the drill pipe, running tool and the lower casing into the borehole, expanding the expandable sleeve of the one or more annular barrier(s) and connecting the lower casing with the upper casing, disconnecting the running tool from the lower casing by means of the disconnecting tool according to claim 1, and raising the running tool, the drill pipe and the disconnecting tool.

15. A well system comprising an upper casing, a lower casing having annular barriers, a running tool and the disconnecting tool according to claim 1.

16. A disconnecting tool according to claim 1, wherein both the inlet and the outlet are positioned exterior to the element and are configured to be exposed to fluid within the borehole.

17. A disconnecting tool according to claim 1, wherein the fluid passage is configured to directly communicate fluid from the lower casing to the drill pipe.

18. A disconnecting tool according to claim 1, wherein the fluid channel passes through the element.

* * * * *